US005560429A

United States Patent [19]

Needham

[11] Patent Number: 5,560,429

[45] Date of Patent: Oct. 1, 1996

[54] FIRE FIGHTING BUCKET FOR AIRCRAFT

[76] Inventor: Robert D. Needham, 6111 Kalamalka Crescent, Richmond, British Columbia, Canada, V7C 2R6

[21] Appl. No.: 246,504

[22] Filed: May 20, 1994

[51] Int. Cl.[6] ..... A62C 3/02

[52] U.S. Cl. ..... 169/53; 169/54; 169/34; 383/72; 244/136; 294/68.22

[58] Field of Search ..... 169/54, 34, 53; 383/59, 60, 72, 75, 76; 244/136; 294/68.21, 68.22

[56] References Cited

U.S. PATENT DOCUMENTS

| | | | |
|---|---|---|---|
| 286,718 | 10/1883 | Linton | 244/136 |
| 3,093,295 | 6/1963 | Kugler | 383/75 |
| 4,474,245 | 10/1984 | Arney | 169/53 |
| 4,576,237 | 3/1986 | Arney | 169/53 |

FOREIGN PATENT DOCUMENTS

| | | | |
|---|---|---|---|
| 1516128 | 10/1989 | U.S.S.R. | 244/136 |

OTHER PUBLICATIONS

Copies of pp. 45 and 47 of Bambi Bucket (Registered TM) Operator's Manual Published 21 Oct. 1992, By Sei Industries Ltd. Delta, British Columbia, Canada.

*Primary Examiner*—David M. Mitchell
*Assistant Examiner*—Gary C. Hoge
*Attorney, Agent, or Firm*—Bull, Housser & Tupper

[57] ABSTRACT

A collapsible fire fighting bucket assembly to be suspended from an aircraft for fighting wild fires, the bucket being made of pliable material and having an open upper end for filling from a body of water. A tubular extension extends from an opening in the bottom of the bucket and has a free end formed with a discharge port provided with resilient sealing lips which are brought into sealing engagement with each other to close the port to minimize water leakage from the tubular extension. A harness suspends the bucket from the aircraft and a releasable support releasably supports the free end of the tubular extension within the bucket body extending upwardly from the opening to close the discharge port. The releasable support cooperates with the openings to allow the tubular extension to be rapidly lowered so as to extend downwardly from the bottom to open the discharge port for dumping the water. The sealing lips are drawn together by purse lines passing through openings adjacent the discharge port but spaced from the sealing lips to avoid abrasion of the lips that occurred with prior art bucket valves. The purse lines cooperate with the releasable support to control location of the free end of the tubular extension.

16 Claims, 3 Drawing Sheets

FIRE FIGHTING BUCKET FOR AIRCRAFT

BACKGROUND OF THE INVENTION

The invention relates to a collapsible fire fighting bucket for carrying with a helicopter for fighting forest fires, and in particular to an improved dump valve associated with the bucket.

Collapsible fire fighting buckets carried by helicopters have become standard equipment for fighting wild fires, and examples of such fire buckets are found in U.S. Pat. Nos. 4,474,245 and 4,576,287, both invented by Donald B. Arney. The patents disclose fire fighting buckets made of pliable fabric material having an open upper end with a rim to facilitate filing from an open body of water, a side wall extending downwardly from the rim, and a bottom cooperating with the side wall and having an opening. A tubular extension made of pliable material extends from an opening in the bottom to a free end formed with a discharge port to serve as a dump valve. The discharge port has an array of grommetted openings extending therearound to receive a plurality of cords so that the tubular extension can be drawn upwardly into the bucket by the cords before the bucket is filled with water. The discharge port has a circumferential sealing lip made of soft and resilient material, which forms two opposite lip portions which are brought into sealing engagement with each other to minimize water leakage from the tubular extension when the dump valve is positioned below the water surface in the bucket. The sealing lip has an array of unprotected openings extending therearound and in alignment with the grommetted openings in the port. The plurality of cords serve as purse lines and pass through the aligned openings to draw the sealing lips into engagement with each other when the cords are tightened. Tension in the cords supports the extension, and the extension is drawn upwardly through the bucket to be supported in a position which can be below an upper level of water within the bucket. Weight of water acting on the tubular extension tensions the cords further and ambient pressure of water acting on the sealing lips augments initial sealing generated by tension in the cords.

To dump the water the valve is opened by rapidly loosening the purse lines by a release or trip mechanism, which permits the tubular extension to fall quickly through the opening in the bottom of the bucket. The lip portions are opened essentially simultaneously under the weight of water, permitting rapid discharge of water with negligible obstruction.

The prior art bucket has been very reliable and, in general, requires little maintenance. However, one area of wear relates to the array of unprotected openings in the sealing lip portions which receive the cords or purse lines passing therethrough. It has been found that the relatively soft sealing material of the lips can wear rapidly after many deployments of the valve due to abrasion of the purse lines, and the wear results in loss of sealing effectiveness with a corresponding leakage of water through the dump valve.

SUMMARY OF THE INVENTION

The invention reduces the difficulties and disadvantages of the prior art by relocating the sealing lips to be separated from the grommetted openings which receive the purse lines. The grommetted openings are adjacent the free end of the extension and the sealing lips are located inwardly therefrom so that the relatively soft sealing lips are essentially free of abrasion from the lines. In other words, the plurality of grommetted openings which receive the purse lines are spaced from the sealing lip, and thus during actuation of the dump valve the purse lines do not abrade the softer surface of the sealing lip, thus reducing the wear problems of the prior art.

A collapsible fire fighting bucket according to the invention comprises an open bucket body of pliable material, a tubular extension made of pliable material, a harness for suspending the bucket from the aircraft, and a releasable support for releasably supporting the tubular extension. The open bucket body has an open upper rim to facilitate filling from an open body of water, a side wall extending downwardly from the rim, and a bottom cooperating with the side wall and having an opening. The tubular extension extends from the opening in the bottom and has a free end formed with a discharge port to serve as a dump valve. The discharge port has a sealing lip which forms two opposite lip portions which are brought into sealing engagement with other for minimizing water leakage from the tubular extension. The tubular extension has a plurality of openings spaced from the sealing lip so that the sealing lip is essentially free of obstruction. The harness comprises a connector for connecting to the aircraft and a plurality of first flexible tension links connected between the bucket and the connector. The releasable support comprises a second flexible tension link cooperating with the openings in the extension for holding the tubular extension in a raised position in which the free end thereof extends upwardly from the bottom with the discharge port positioned below a full water level in the bucket. The support means is releasable for allowing the tubular extension to extend downwardly from the bottom of the bucket for dumping the water.

Preferably, the plurality of openings in the tubular extension are disposed on a side of the sealing lip remote from the bottom of the bucket, so as to be adjacent an outer edge portion of the tubular extension. The outer edge portion of the tubular extension is stiffer than the remaining portion of the extension to reduce chances of undesirable folds occurring adjacent the outer edge portion when the lip portions are brought into sealing engagement with each other.

A detailed disclosure following, related to drawings, describes a preferred embodiment of the invention which is capable of expression in structure other than that particularly described and illustrated.

DETAILED DESCRIPTION

Figure 1:
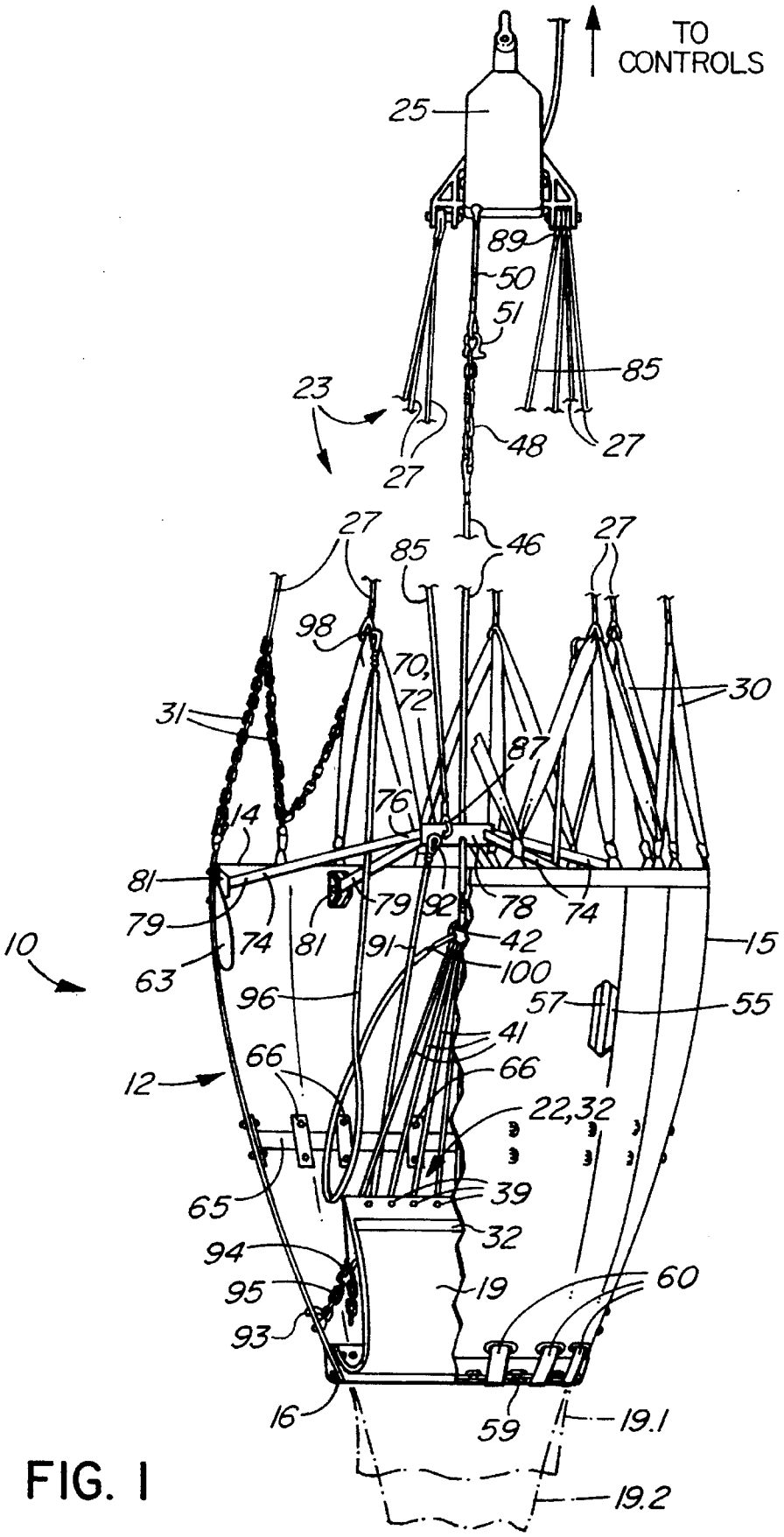
FIG. 1 is a simplified fragmented, partially sectioned side elevation of a bucket according to the invention as suspended from an aircraft, a portion of the dump valve thereof being shown in a retracted and closed position in full outline, and fragmented in broken outline in an open extended or discharge position, some internal details of the bucket being shown.
Figure 2:
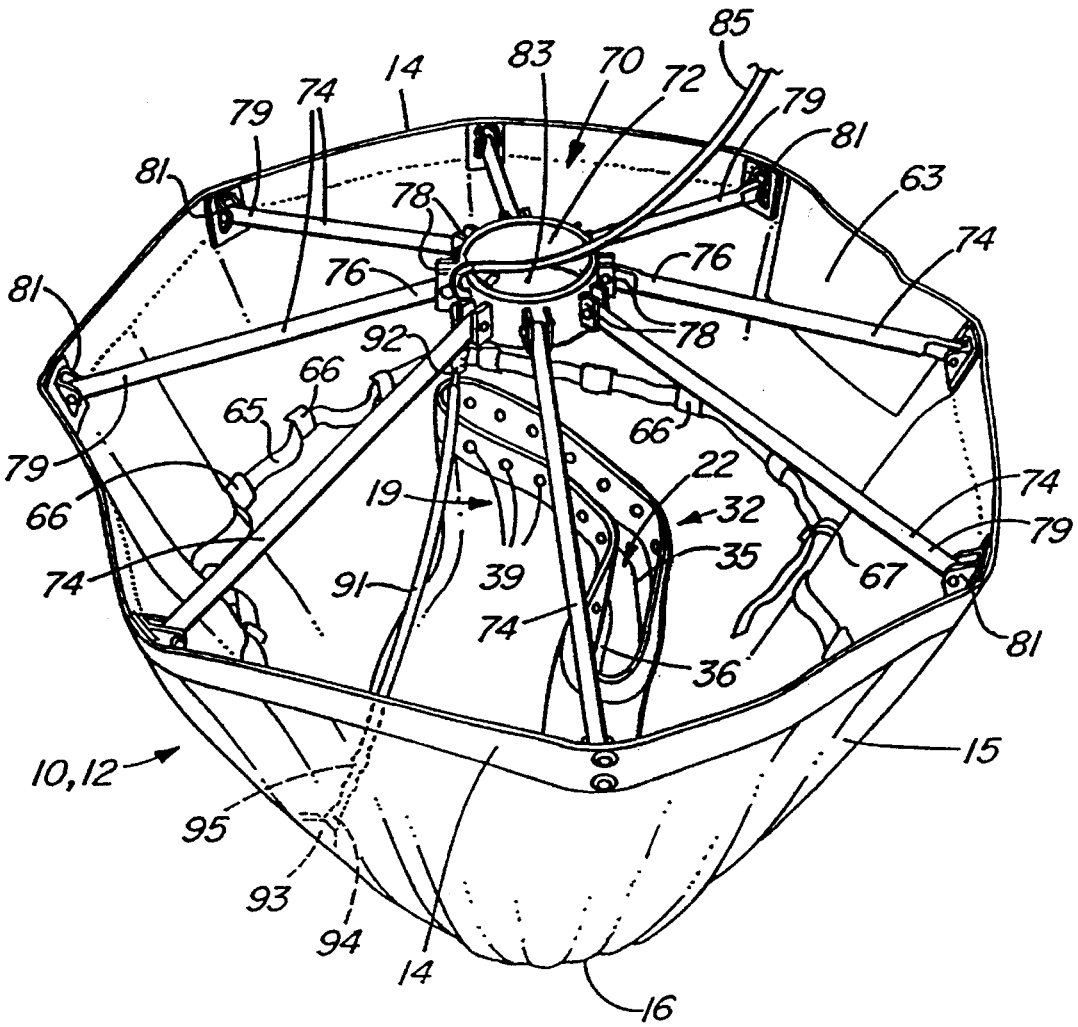
FIG. 2 is a simplified perspective of the bucket shown with the dump valve thereof in the retracted position, with cables and lines associated with the harness and releasable support omitted for clarity.

FIGS. 1 and 2

A fire fighting bucket 10 according to the invention bears many similarities to the earlier fire fighting buckets as disclosed in the aforementioned U.S. Pat. Nos. 4,474,245 and 4,576,237, the disclosures of which are incorporated herein by reference. A brief description of some prior art aspects of the bucket follows, and additional details can be found from the above references. The bucket 10 has an open bucket body 12 made of a tough pliable material, for example a vinyl impregnated woven synthetic fabric, and has an open upper rim 14 to facilitate filling from an open body of water, i.e. by dipping into the water. The body has a side wall 15 extending downwardly from the rim, and a bottom 16 cooperating with the side wall and having an opening 17. A tubular extension 19 made of pliable material is shown in a retracted position extending upwardly into the bucket from the opening in the bottom, and has a free end portion 21 formed with a discharge port 22 to serve as a dump valve. In FIG. 1, the tubular extension is shown fragmented in full outline in the retracted or raised position, and is also partially shown in broken outline in an extended or lowered position 19.1 extending downwardly from the bucket with the dump valve opened to permit discharge of water from the bucket.

The assembly 10 also includes a harness 23 for suspending the bucket from an aircraft, not shown, the harness comprising a control head 25 which also serves as a connector for connecting to the aircraft, and a plurality of first flexible tension links 27 e.g. support cables, connected to the connector 25. The control head functions similarly to that disclosed in the patents and in particular has a spring-loaded reel, a trip mechanism for holding and releasing the reel, and controls for remote operation thereof, none of which is shown herein. The harness 23 also includes a plurality of support cables or flexible fabric straps 30 disposed in a zig-zag fashion around and extending upwardly from the upper rim 14 to connect with the plurality of cables or flexible tension links 27. One portion of the rim has a plurality of link chains 31 similarly connected in a zig-zag fashion to the rim and the tension links 27 to weight one side of the bucket to unbalance the bucket so as to facilitate filling as will be explained.

The discharge port 22 has a sealing lip 32 extending circumferentially therearound which forms two opposite sealing lip portions 35 and 36 (FIGS. 2 and 3 only) which are brought into sealing engagement with each other for minimizing water leakage from the tubular extension. The tubular extension has a plurality of openings 39 which cooperate with a plurality of purse lines 41 extending downwardly from a connector ring 42. The relative location of the sealing lip portions 35 and 36 and the plurality of openings 39 are of the essence of the invention, as will be described with reference to FIGS. 3 and 4. The connector ring is secured to a trip line 46, which in turn is connected to a short length of trip line chain 48, which is connected with a releasable connector 51 to an outer end of a reel line 50 which is wound on the spring-loaded reel within the control head. The spring-loaded reel is actuated by solenoid controlled linkages to permit the reel to rotate quickly to rapidly slacken the reel line and trip line when the bucket is loaded with water so as to discharge the load, and to automatically rewind the reel line to return the tubular extension to the raised position immediately after the discharge. Operation of the dump valve is described in the previously mentioned U.S. patents. The chain 48 in combination with the releasable connector 51 permits easy adjustment of the length of the trip line 46 which in turn adjusts position of the discharge port 22 when in the raised position within the bucket.

The bucket side wall 15 includes a plurality of batten pockets 55 extending longitudinally between the rim 14 and the bottom 16 and carrying stiffening battens 57 within the pockets. The battens provide sufficient stiffness to the side wall 15 to facilitate rapid deployment of the bucket and to provide variable filling capacities as described in the previous patents. Upper and lower ends of the battens are connected to the rim 14 and the bottom 16 using a plurality of loops and fasteners and serve to relieve the side wall of some load from the water when filling the bucket. A length of relatively heavy chain 59 passes through plurality of bottom loops 60 and extends around the bottom 16 to weight the bucket so as to facilitate sinking of the bucket into a body of water. A ballast pouch 63 is connected adjacent the rim 14 on the side of the bucket having the chain 31, the combined effects of the off-centered weight of the chain 31 and the pouch 63 causing the bucket to be unbalanced and to fall over to the heavier side when contacting the water, so as to rapidly immerse the rim 14 below the surface of the water to facilitate filling of the bucket.

A cinch strap 65 passes circumferentially around a portion of the bucket approximately midway between the rim 14 and bottom 16. The strap passes through a plurality of loops 66 provided on an inner surface of the side wall 15 and has opposite ends retained by a buckle 67. The strap 65 is used to vary size of the circumference of the bucket at a position about midway between the rim and the bottom to adjust capacity of the bucket to accommodate different operating conditions, as is described with reference to the second U.S. patent above.

The bucket assembly also includes a rim opener 70 which has a hollow ring-like central hub portion 72 and a plurality of spokes 74. The rim opener 70 serves to automatically and essentially instantly open the bucket for deployment, i.e. in a very short space of time similarly to an umbrella, and is not disclosed in the two patents above. In the two patents above, the prior art bucket rim was stiffened by a plurality of circumferentially extending battens or stiffeners which were inserted into circumferentially extending sleeves passing around the rim. To permit the prior art bucket to be folded, the battens were manually removed, and therefore, before deployment, it was necessary to reinsert the battens. This was time consuming, and the rim opener 70 was therefor developed and has proven successful over many years. The spokes 74 have inner ends 76 hinged to brackets 78 extending radially from the hub portion 72, and have outer ends 79 hinged to brackets 81 adjacent the rim 14. The spokes have equal lengths such that, when the rim is essentially fully opened as shown, the spokes are disposed generally radially and essentially coplanar with each other. The angle of the spokes to a diametrical plane of the rim is not critical and preferably extends somewhat above the upper rim 14 as best seen in FIG. 1 so as to define a shallow conical envelope.

The trip line 46 passes through a central opening 83 of the hub portion 72 to guide the line 46 which in turn tends to guide the extension 19. In some smaller sized buckets the hub portion 72 is closer to the extension 19 and so the purse lines 41 can pass from the extension 19 upwardly through the central opening 83 of the central hub portion 72, which thus guides the purse lines between the ring 42 and the free end portion. A rim opening line 85 has an outer end 87 connected to the central hub portion 72 and an inner end 89 connected to the control head 25. Length of the line 85 is adjusted so that, when the links 27 are taut, the hub portion 72 is raised somewhat above the level of the rim 14 as shown to ensure that the line 85 pulls up the hub portion before the links 27 tighten to ensure rapid opening of the bucket and holding the bucket open by an "over-centering" action.

At least one restrictor line 91 has an inner end 92 connected to the hub portion, and an outer end 94 connected to a bracket 93 secured to an inner portion of the side wall 15. To facilitate adjustment of length of the line 91, a short length of chain 95 can be provided as shown adjacent the end 94 of the line 91 and is releasably connected to the bracket 93 on the side wall to accommodate length changes as the cinch strap is adjusted, the length of chain being best seen in FIG. 1. Thus, it can be seen that the central hub portion 72 is restrained against excessive downward movement by the rim opening line 85, and against excessive upward movement by the restrictor line 91.

An extension restrainer line 96 has an inner end 98 connected to one of the links 27, and an outer end 100 connected to the connector ring 42 which carries the purse lines and the trip line 46. The length of the line 96 is adjusted so that when the extension 19 is fully extended below the bucket, the line 91 becomes taut before the trip line 46 becomes taut. The this way, during rapid outflow of water through the discharge port, drag of water on the purse lines 41 does not "over-extend" the trip line 46. If the line 46 were over-extended, the spring of the spring-loaded reel (in the control head 50) carrying the reel line 50 and trip line 46 could become over-extended or broken.

FIG. 3

The sealing lip portions 35 and 36 are made from one or more portions of resilient sealing material, such as "Neoprene", which has inner edge portions 103 and 105 located generally adjacent the bottom of the bucket, and outer edge portions 107 and 108 located generally adjacent the free end portion 21 of the tubular extension 19 as shown. The portion of resilient sealing material is folded to produce a generally annular fold which forms the outer edge portions 107 and 108, with generally adjacent free edges forming the inner edge portions 103 and 105. Two rows of stitches 109 and 110 secure the folded resilient sealing material to an inner surface of the tubular extension to produce a seal generally similar to that disclosed in the said prior patent.

The plurality of openings 39 are positioned as close to the discharge port 22 as practical and are reinforced with grommets 104 which are spaced generally equally from the discharge port 22 so to permit alignment of the openings 39 on opposite sides of the extension, that is adjacent the sealing lip portions 35 and 36 which are automatically formed by closing the dump valve using the purse lines. The plurality of openings 39 are disposed between the outer edge portions 107 and 108 of the lip portions 35 and 36 and a terminal edge 106 of the extension 19. The terminal edge 106 is a circumferential fold of a relatively wide hem which extends inwardly so that an outer edge of the material is located between the lip portions 35 and 36 and the extension 19 and is thus hidden. The wide hem ensures that the free end portion 21 of the extrusion 19 is stiffer than a remaining portion of the extension. This stiffness is to reduce chances of undesirable folds occurring adjacent the discharge port 22 when the lip portions 35 and 36 are brought into sealing engagement with each other by tension in the purse lines 41. Thus, the plurality of openings in the tubular extension are disposed on a side of the sealing lip 32 remote from the bottom 16 of the bucket so as to be adjacent the outer edge portion, i.e. the terminal edge 106 of the tubular extension.

The purse lines 41 are essentially identical, and a typical purse line is described as follows. Each purse line passes through a pair of aligned openings 39 in the grommets 104 which are spaced from but adjacent the two opposite lip portions 35 and 36 as shown. Thus, each opening is associated with a respective lip portion, but is spaced therefrom to avoid damage to the soft sealing material of the lip portion when the purse line runs through the opening. The line 41 has an outer end having an end stop 115 and an inner end 117 connected to the ring 42, which in turn is supported by the trip line 46, as seen in FIG. 1. The end stop 115 is a figure-of-eight knot tied adjacent the end of the line, with a washer 119 fitted between the grommet 104 and the knot. The inner end of the purse line is secured to the ring 42 with a suitable knot, usually provided with several half-hitches to prevent inadvertent undoing of the knot. The length of the purse lines are individually and carefully adjusted to ensure that, when the ring 42 is located in a full extended position as shown in FIG. 1, the sealing lip portions 35 and 36 are drawn tightly and evenly into engagement with each other, with oppositely facing terminal edges 106 being generally coplanar with each other. Thus, it can be seen that the tubular extension has the plurality of openings 39 spaced from the sealing lip 32 so that the sealing lip portions 35 and 36 are essentially free of obstruction and located to be essentially free of abrasion by the purse lines during actuation of the dump valve.

OPERATION

As previously described, to erect the present bucket from a collapsed state does not require the time-consuming insertion of separate battens to stiffen the rim 14 to hold the bucket open as in the buckets of the said patents. Instead, the present bucket can be rapidly opened from the collapsed state by moving the hub portion 72 to the extended position as shown in FIG. 1, during which time the rim 14 becomes essentially circular and fully opened. The tubular extension 19 is held in the raised position by the purse lines 41 and the trip line 46 which are controlled by the control head.

The bucket is suspended from the helicopter using the control head and connector 25 as previously described in the patents, and is lowered into an open body of water, whereupon the off-centered weight from the ballast pouch 63 and chains 31 causes the bucket to tip to the side with the pouch, causing the bucket to rapidly fill with water and tend to sink. The helicopter pulls the bucket upwardly and transports it to the dump site. When the bucket is filled, the sealing lip portions 35 and 36 are below the surface of water in the bucket, and ambient water pressure forces the sealing lip portions into sealing engagement with each other, minimizing leakage therefrom. Tension in the purse lines initially draws the sealing lip portions into sealing engagement with each other, the sealing engagement being further enhanced by water pressure acting inwardly on the sealing lips.

When the water is to be released through the dump valve, the trip mechanism in the control head 25 is actuated remotely so that weight acting on the trip line 46 causes the reel line 50 to unwind rapidly from the reel so as to lower the trip line 46 rapidly which in turn lowers the ring 42. This in turn lowers the closed dump valve and slackens the purse lines 41, thus causing the tubular extension 19 to turn inside out as it passes through the opening 17 in the bottom, and the sealing lips to separate to permit discharge of water with negligible obstruction of the discharge port. The bucket is emptied rapidly, and the reel rapidly re-winds the reel line 50 thereonto, concurrently pulling up the trip line 46, and with it the extension 19 to be located in a raised position within the empty bucket.

For convenience, the trip line 46 and the reel line 50 can be referred to as a second flexible tension link which serves as a releasable support for releasably supporting the free end of the tubular extension. The releasable support cooperates through the ring 42 with the purse lines 41 connected thereto, the purse lines 41 being termed a plurality of third flexible tension links. It can be seen that each third flexible tension link cooperates with the second flexible tension link and also with the lip portions for bringing the lip portions into sealing engagement with each other when tension is applied to the second flexible tension link.

Thus, it can be seen that the second flexible tension link, i.e. the trip line 46, cooperates with the openings 39 in the tubular extension for holding the tubular extension in a raised position, in which the free end portion 21 thereof extends upwardly from the bottom 16 with the discharge port being closed and positioned below a full water level in the bucket. Clearly, the support means are releasable for allowing the tubular extension to extend downwardly from the bottom and to open for dumping the water.

FIG. 4

Figure 3:
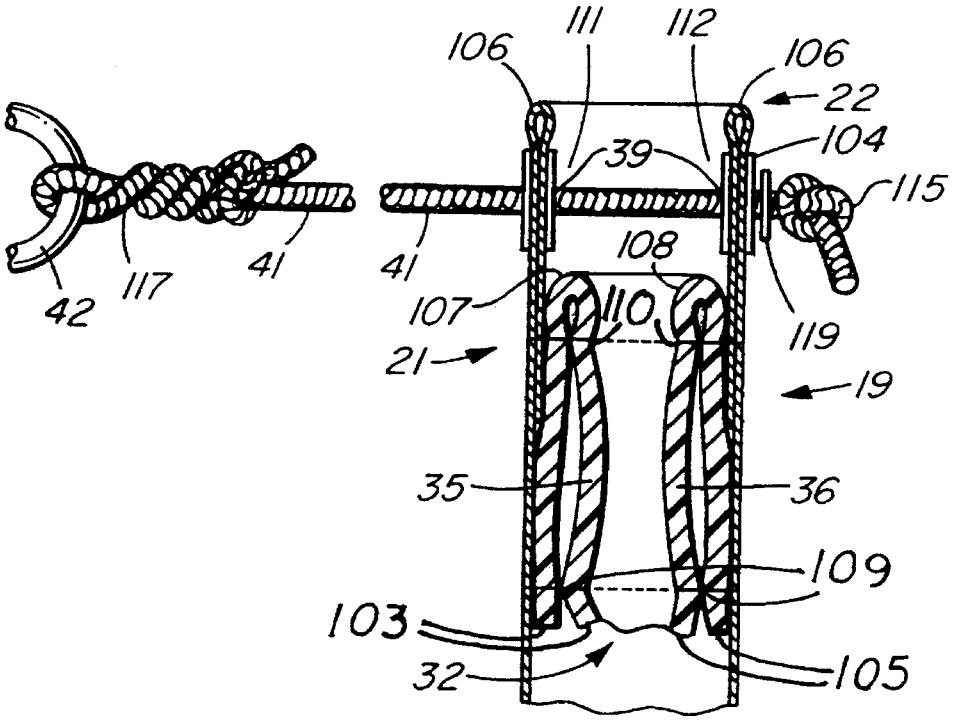
FIG. 3 is a simplified fragmented longitudinal section through a free end portion of the dump valve shown in the retracted position, with sealing lip portions thereof shown spaced apart for clarity and one purse line and associated structure.
Figure 4:
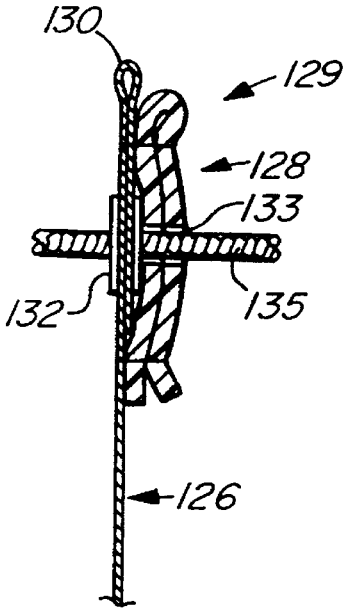
FIG. 4 PRIOR ART
FIG. 4 is a simplified fragmented section in a plane generally similar to that of FIG. 3, showing one prior art sealing lip portion and associated purse line.

A prior art tubular extension 126 has a sealing lip portion 128 passing closely adjacent and circumferentially around a terminal edge 130 adjacent a discharge port 129 of the extension. The tubular extension has a plurality of openings extending therealong, one opening being shown and reinforced with a grommet 132 located approximately midway along width of the sealing lip portion 128. A purse string 135 passes through the grommet 132 and an opening 133 in the lip portion 128 aligned therewith, the opening 133 being unprotected. It can be seen that passage of the purse string through the opening 133 can cause wear to the relatively soft material of the lip portion which has a poor abrasion resistance. Consequently, portions of the soft sealing material adjacent the opening 133 tend to disintegrate after some time and this could cause leakage from the bucket. By comparing FIG. 4 with FIG. 3, it can be seen that the sealing lip portions 35 and 36 of FIG. 3 are well clear of the purse line 41 and the openings 39, and consequently wear of the sealing lip portions 35 and 36 due to the purse string is essentially eliminated in the present invention.

ALTERNATIVES

For many large sized buckets the tubular extension is a generally parallel tube, that is circumference of the extension adjacent the opening in the bottom 16 is generally equal to circumference adjacent the discharge port 22. However, for smaller sized buckets, depending on the stiffness of the material of the dump valve, its diameter and length, sometimes an unduly large upwards force is required to draw the free end portion 21 back through the opening in the bottom after discharge of water from the bucket. This is because, in smaller buckets, the relative stiffness of the material adjacent the free end resists folding as it passes through the opening, and this causes interference. By geometry, if the tubular portion is parallel sided, the folded size of the free end in a straight line is greater than diameter of the opening in the bottom through which it must pass. With relatively large sized buckets and relatively soft material, there is little difficulty due to flexibility of the material, but with the smaller buckets relative stiffness in the lip portion can cause difficulty in retracting the free end portion back into the bucket.

This problem is overcome by providing an alternative tubular extension which has a circumference at the free or outer end thereof which is smaller than the circumference adjacent the opening in the bottom of the bucket, so that the alternative tubular extension tapers in direction of discharge of water. The difference in circumferences at opposite ends thereof can be relatively small, for example between 10 and 20 percent of the size of the opening in the bucket, so that the taper is relatively shallow. This alternative tapered extension with an exaggerated taper angle is shown at 19.2 in FIG. 1. It is added that if the taper becomes excessive, discharge of water from the extension can be "broken-up" which contrasts with the preferred essentially "un-broken" body of water falling from the bucket during an ideal dump. Consequently, a tapered tubular extension is used only when necessary.

What is claimed is:

1. A collapsible fire fighting bucket assembly to be suspended from an aircraft comprising:

(a) an open bucket body of pliable material having an open upper rim to facilitate filling from an open body of water, a side wall extending downwardly from the rim and a bottom cooperating with the side wall and having an opening;

(b) a tubular extension made of pliable material and extending from the opening in the bottom, the tubular extension having a free end formed with a discharge port to serve as a dump valve, the discharge port having a sealing lip of resilient sealing material which forms two opposite lip portions which are brought into sealing engagement with each other for minimizing water leakage from the tubular extension, the tubular extension having a plurality of openings spaced from the resilient sealing material of the sealing lip so that the resilient material of the sealing lip is clear of the openings and essentially free of obstruction;

(c) a harness for suspending the bucket from the aircraft, the harness comprising a connector for connecting to the aircraft and a plurality of first flexible tension links connected between the bucket and the connector; and (d) a releasable support for releasably supporting the free end of the tubular extension, the support comprising a second flexible tension link cooperating with the openings in the extension for holding the tubular extension in a raised position in which the free end thereof extends upwardly from the bottom with the discharge port positioned below a full water level in the bucket, the support means being releasable for allowing the tubular extension to extend downwardly from the bottom of the bucket for dumping the water.

2. A fire fighting bucket as claimed in claim 1, in which:

(a) the plurality of openings in the tubular extension are disposed on a side of the resilient sealing material remote from the bottom of the bucket, so as to be located between the sealing material and a terminal edge of the free end of the extension.

3. A fire fighting bucket as claimed in claim 2, in which:

(a) the outer edge portion of the tubular extension is stiffer than the remaining portion of the extension to reduce chances of undesirable folds occurring adjacent the outer edge portion when the lip portions are brought into sealing engagement with each other.

4. A fire fighting bucket as claimed in claim 1, further comprising:

(a) a plurality of third flexible tension links, each third flexible tension link cooperating with the second flexible tension link and also cooperating with the lip portions for bringing the lip portions into sealing engagement with each other when tension is applied to the second flexible tension link.

5. A fire fighting bucket as claimed in claim 1, further comprising:

(a) a plurality of third flexible tension links, each third flexible tension link cooperating with the second flexible tension link and passing through a pair of aligned openings, each opening being associated with a respective lip portion of the sealing lip for bringing the lip portions into sealing engagement.

6. A fire fighting bucket as claimed in claim 5, in which:

(a) each third flexible tension link has an outer end having an end stop and an inner end cooperating with the second flexible tension link, the third tension link passing from the end stop, through a pair of aligned openings in the lip portions to the inner end.

7. A fire fighting bucket as claimed in claim 1, further comprising:

(a) a rim opener having a central hub portion and a plurality of spokes, the spokes having inner ends hinged to the central hub portion and outer ends hinged adjacent to the upper rim of the bucket, the spokes having equal lengths such that, when the rim is essentially fully opened, the spokes are disposed generally radially and essentially co-planar with each other.

8. A fire fighting bucket as claimed in claim 7, wherein:

(a) said releasible support further comprises a plurality of third flexible tension links, each third flexible tension link cooperating with the second flexible tension link and also cooperating with the lip portions for bringing the sealing lip portions into sealing engagement with each other when tension is applied to the second flexible tension link, and the bucket further comprises:

(b) said central hub portion having an opening therein forming a guide to receive said releasible support therethrough.

9. A fire fighting bucket as claimed in claim 8, in which:

(a) each third flexible tension link cooperates with the second flexible tension link and passes through a pair of aligned openings in the tubular extension, each opening being associated with a respective lip portion of the sealing lip for bringing the lip portions into sealing engagement.

10. A fire fighting bucket as claimed in claim 9, in which:

(a) each third flexible tension link has an outer end having an end stop and an inner end cooperating with the second flexible tension link, the third link passing from the end stop through the pair of aligned openings in the two lip portions to the inner end.

11. A fire fighting bucket as claimed in claim 7, in which:

(a) the plurality of openings in the tubular extension are disposed on a side of the sealing lip remote from the bottom of the bucket, so as to be adjacent an outer edge portion of the extension.

12. A fire fighting bucket as claimed in claim 11, in which:

(a) the outer edge portion of the tubular extension is stiffer than the remaining portion of the extension to reduce chances of undesirable folds occurring adjacent the outer edge portion when the lip portions are brought into sealing engagement with each other.

13. A fire fighting bucket as claimed in claim 1, in which:

(a) the tubular extension has a circumference at the outer end thereof which is smaller than the circumference adjacent the opening in the bottom, so that the extension tapers in direction of discharge of water.

14. A fire fighting bucket as claimed in claim 6, in which:

(a) the tubular extension has a circumference at the outer end thereof which is smaller than the circumference adjacent the opening in the bottom, so that the extension tapers in direction of discharge of water.

15. A fire fighting bucket as claimed in claim 12, in which:

(a) the tubular extension has a circumference at the outer end thereof which is smaller than the circumference adjacent the opening in the bottom, so that the extension tapers in direction of discharge of water.

16. A fire fighting bucket as claimed in claim 1 in which:

(a) the portion of resilient sealing material has inner and outer edge portions generally adjacent the bottom of the bucket and the free end of the tubular extension respectively.

* * * * *